US011688574B2

(12) United States Patent
Wu

(10) Patent No.: US 11,688,574 B2
(45) Date of Patent: Jun. 27, 2023

(54) ELECTROMAGNETIC RELAY

(71) Applicant: SONG CHUAN PRECISION CO., LTD., New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 17 days.

(21) Appl. No.: 17/472,707

(22) Filed: Sep. 13, 2021

(65) Prior Publication Data

US 2023/0085584 A1 Mar. 16, 2023

(51) Int. Cl.
*H01H 9/30* (2006.01)
*H01H 50/12* (2006.01)

(52) U.S. Cl.
CPC ..... *H01H 50/12* (2013.01); *H01H 9/30* (2013.01)

(58) Field of Classification Search
CPC ..... H01H 50/12; H01H 9/30
USPC ..... 335/201
See application file for complete search history.

(56) References Cited

U.S. PATENT DOCUMENTS 6,700,466 B1 * 3/2004 Yamamoto ..... H01H 9/302 335/201
7,839,243 B1 * 11/2010 Chen ..... H01H 9/36 218/151
10,211,003 B1 * 2/2019 Fasano ..... H01H 9/02
2012/0313737 A1 * 12/2012 Iwamoto ..... H01H 50/56 335/185
2015/0022296 A1 * 1/2015 Takaya ..... H01H 50/023 335/201

* cited by examiner

*Primary Examiner* — Alexander Talpalatski
(74) *Attorney, Agent, or Firm* — Fei-hung Yang

(57) ABSTRACT

An electromagnetic relay includes a base, at least one fixed conductive sheet assembly, at least one movable conductive sheet assembly, at least one arc blow component, an electromagnet and an outer cap. The fixed conductive sheet assembly includes a fixed connecting plate and a fixed contact, and the movable conductive sheet assembly includes a movable connecting plate and a movable contact. The base is made of a thermal conductive polymer, and the fixed connecting plate has a first heat conduction part installed in the base and a second heat conduction part connected to the first heat conduction part and extended to an outer side of the base. The electromagnetic relay further includes at least two thermal conduction components installed in the base and symmetrically configured on both opposite sides of the fixed and movable contacts respectively for dissipating the heat generated by the electromagnetic relay.

12 Claims, 14 Drawing Sheets

ELECTROMAGNETIC RELAY

BACKGROUND

Technical Field

The present disclosure relates to the technical field of electromagnetic relays. More particularly, the present disclosure relates to an electromagnetic relay with excellent heat conduction performance and capable of extending the service life of the electromagnetic relay effectively.

Description of Related Art

In general, a relay generates a large amount of heat during its operation, and heat dissipation is a long existing problem that requires related manufacturers to give immediate attentions and feasible solutions. The operation of the relay also brings high-temperature heat, not just causing damage to the components of the relay only, but also affecting the operation of the relay. Therefore, the design of a heat conduction part is an important factor that determines the quality and service life of the relay, and it is a main subject for the designers and developers of the related industry to find a way to dissipate the heat and eliminate the electric arc generated during the operation of the electromagnetic relay, so as to improve the safety, service life and reliability of the relay effectively. At the same time, the electrical design, structure, and volume of the relay are also taken into consideration to meet market requirements.

In view of the facts that the current connection between the relay and the circuit system is uneasy-to-operate and will increase the burden on the operators; the relay will generate a large amount of heat after a long time use; the current relay has a poor heat dissipation effect that may damage the relay and its electrical connection; and the circuit system reduces the efficiency of use, the discloser of this disclosure based on years of experience in the related industry to conduct extensive research and experiment, and finally developed a kind of electromagnetic relay to overcome the shortcomings of the conventional relay.

SUMMARY

Therefore, it is a primary objective of the present disclosure to provide an electromagnetic relay capable of cutting the electric arc generated during the operation of the relay and dissipating the heat generated during the operation effectively, so as to improve the service life and safety of the relay.

To achieve the foregoing and other objectives, the present disclosure discloses an electromagnetic relay having a base, at least one fixed conductive sheet assembly, at least one movable conductive sheet assembly, at least one arc blow component, an electromagnet and an outer cap. The fixed conductive sheet assembly is installed in the base and includes a fixed connecting plate and a fixed contact, and the fixed contact is disposed at the fixed connecting plate; the movable conductive sheet assembly is configured to be corresponsive to the fixed conductive sheet assembly and disposed in the base and includes a movable plate and at least one movable contact, and the movable contact is disposed at the movable plate and configured to be corresponsive to the fixed contact; the arc blow component is installed on the outer side of the base and disposed on a side of the fixed contact and the movable contact; the electromagnet is installed on a side of the movable conductive sheet assembly for driving the movable plate, so that the movable contact and the fixed contact form an electrical connection or disconnection due to the electromagnetic effect; the outer cap is covered onto the base and the electromagnet is disposed in the outer cap. The electromagnetic relay is characterized in that the base is made of a polymer thermal conductive material, and the fixed connecting plate has a first heat conduction part and a second heat conduction part for dissipating the heat generated by the electrical connection or disconnection of the movable contact and the fixed contact, wherein the first heat conduction part is disposed in the base, and the second heat conduction part is connected to an end of the first heat conduction part and extended to an outer side of the base; the electromagnetic relay further has at least two thermal conduction components installed in the base, and symmetrically configured and disposed on two opposite sides of the fixed contact and the movable contact respectively for dissipating the heat.

Preferably, the first heat conduction part is disposed at a middle section position of the fixed connecting plate to serve as a middle-section thermal conduction part, and the first heat conduction part is embedded into the base, so that the heat can be transmitted from the first heat conduction part to the base for dissipation; the second heat conduction part is disposed at a rear-section position of the fixed connecting plate to serve as a rear-section radiation part, and the second heat conduction part and the first heat conduction part are formed into an integral structure, so that the heat can be radiated and dissipated from the second heat conduction part to the air; and each of the thermal conduction components includes a plurality of thermally conductive fins, a first insulating side plate and a second insulating side plate. The thermally conductive fins are arranged parallelly from top to bottom and spaced from one another, and the first insulating side plate is connected to a first side of each of the thermally conductive fins, and the second insulating side plate is connected to a second side of each of the thermally conductive fins, wherein the first side and the second side are configured to be parallel and opposite to each other, and the thermally conductive fins have a spacing D equal to 0.5~2.5 mm, and the quantity of thermally conductive fins is to 5~15.

Preferably, an end of the first heat conduction part of the fixed connecting plate, which is opposite to the end that connected to the second heat conduction part, is extended to form a third heat conduction part, and the third heat conduction part is disposed at a front-section position of the fixed connecting plate to serve as a front-section thermal convection part, and the third heat conduction part is configured to be opposite to the movable conductive sheet assembly to form a high temperature formation zone and a convection zone, and the high temperature formation zone and the convection zone are arranged vertically up and down relative to each other, and the convection zone is exposed from the base and clamped with the outer surface of the base to form a thermal convection space, and the high temperature formation zone is provided for receiving the heat generated during the operation of opening and closing (or contacting and detaching) the fixed contact and the movable contact, and the heat is dissipated to the outside through the convection zone and the thermal convection space.

DESCRIPTION OF THE EMBODIMENTS

Figure 1A:
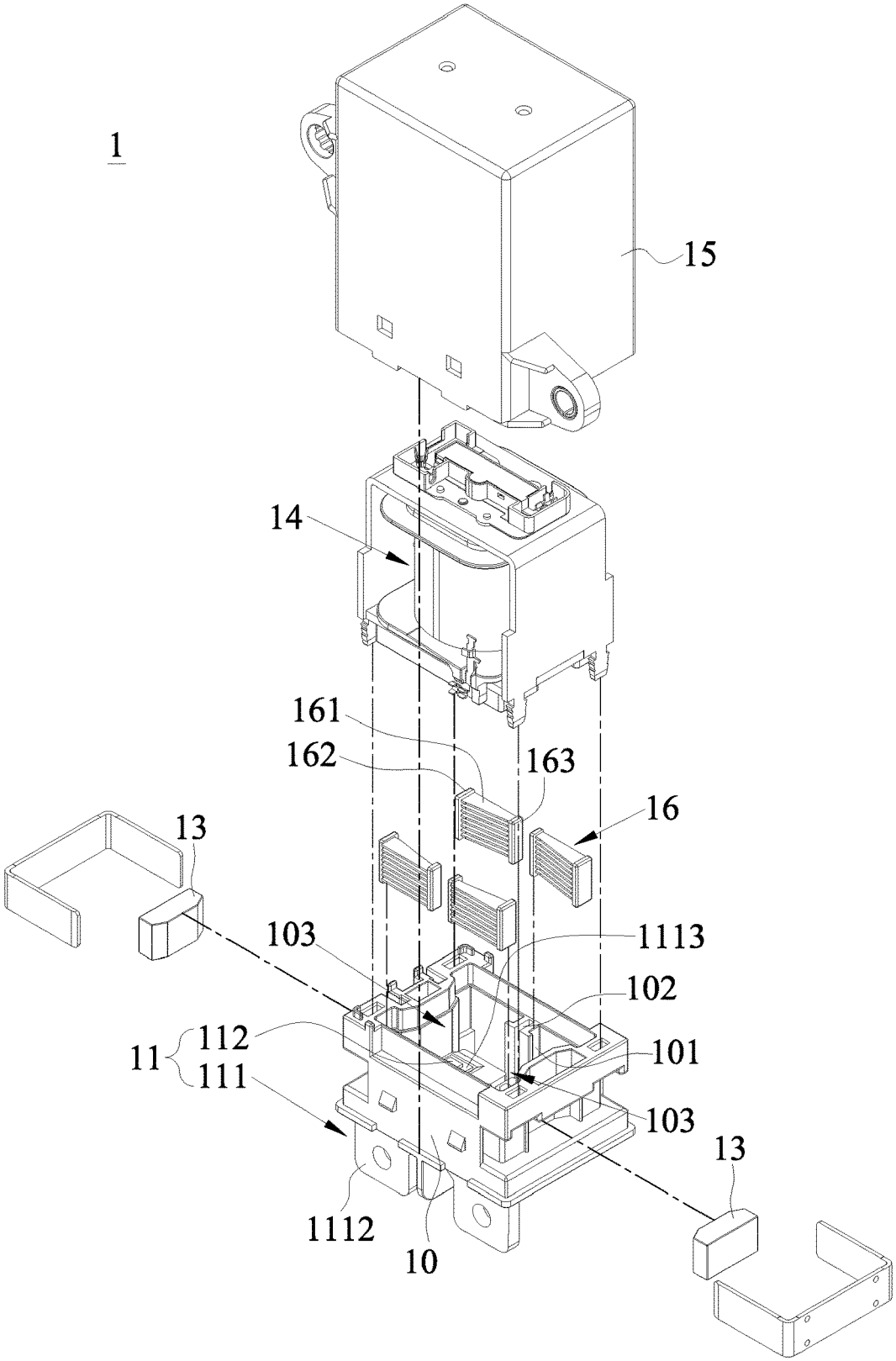
FIG. 1A is an exploded view of an electromagnetic relay in accordance with a first embodiment of this disclosure.
Figure 1B:
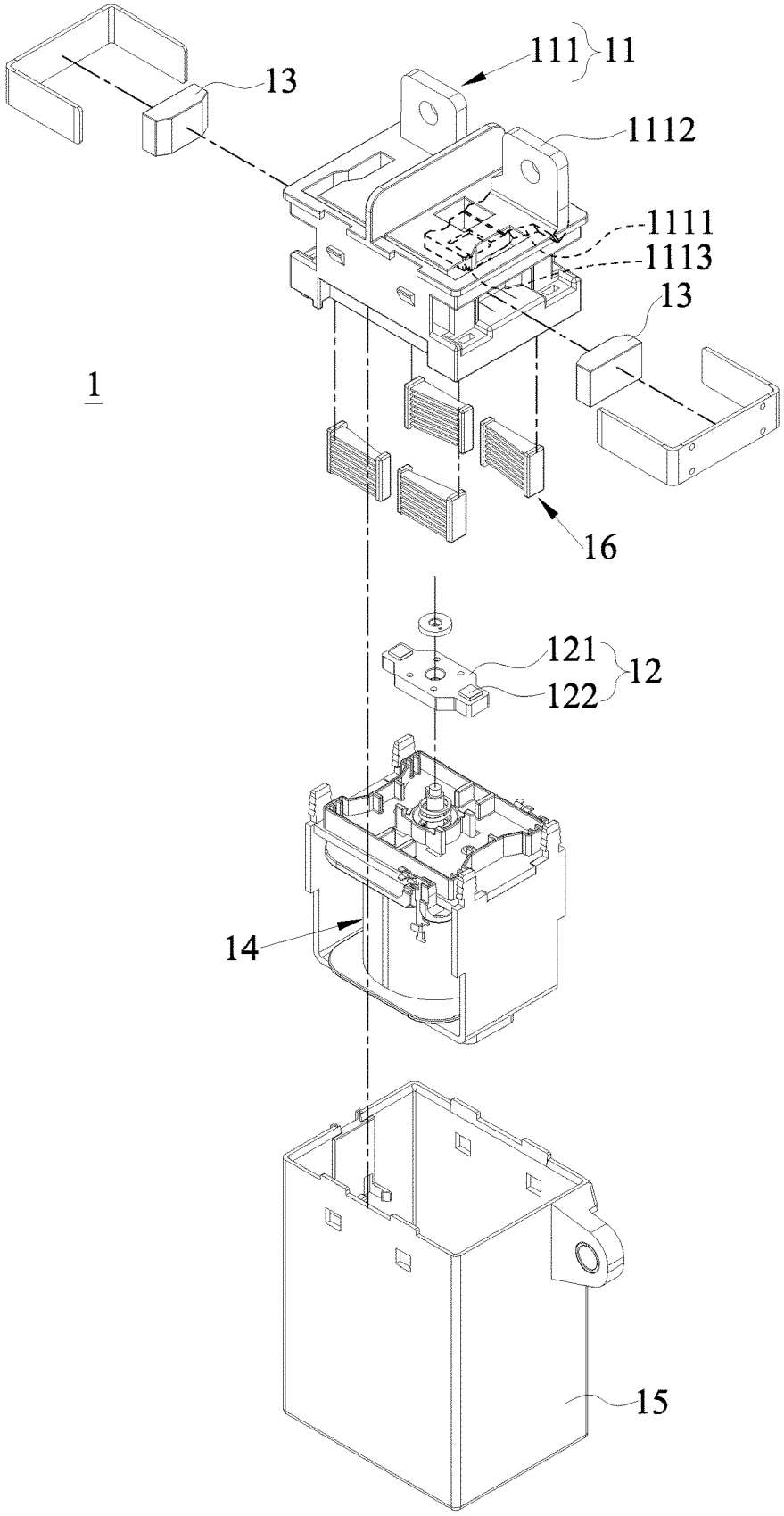
FIG. 1B is another exploded view of an electromagnetic relay in accordance with a first embodiment of this disclosure.
Figure 2:
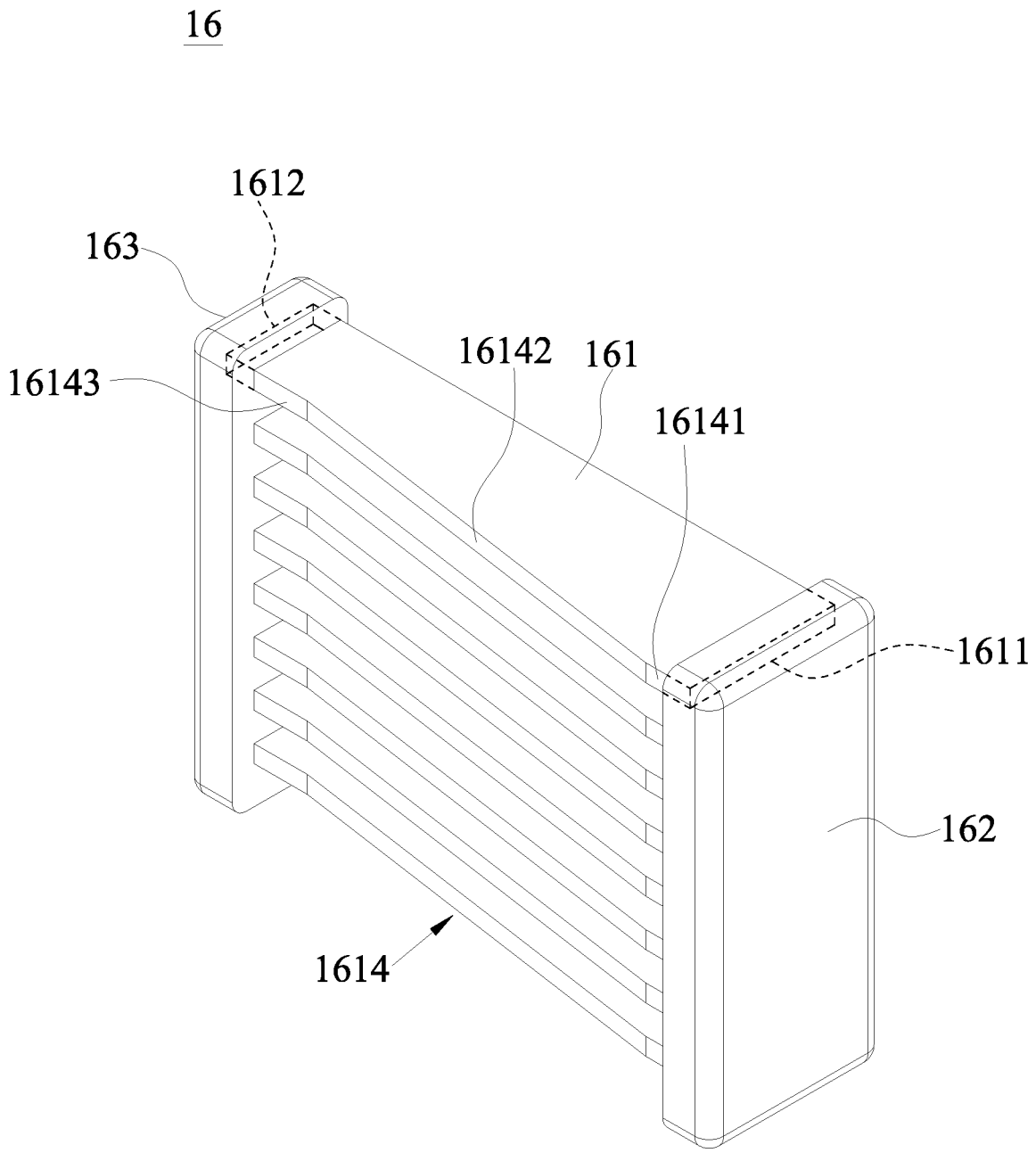
FIG. 2 is a perspective view of a thermal conduction component in accordance with the first embodiment of this disclosure.
Figure 3:
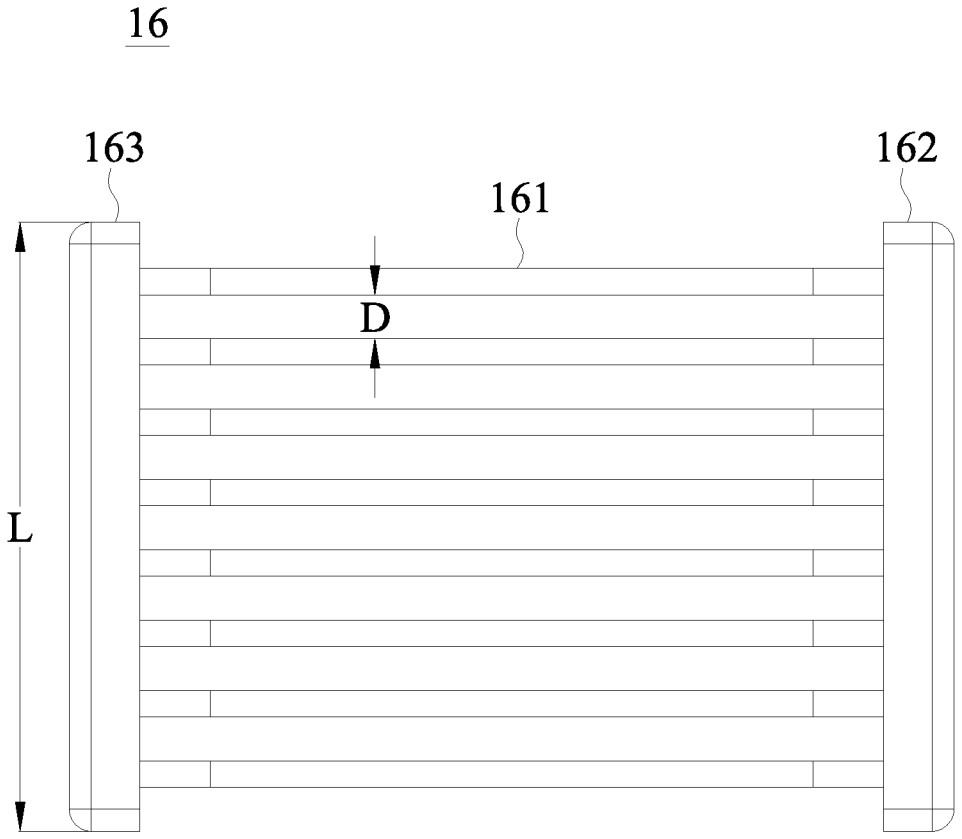
FIG. 3 is a planar view of a thermal conduction component in accordance with the first embodiment of this disclosure.

With reference to FIGS. 1A to 4C for the two exploded views of an electromagnetic relay, the perspective view and planar views of a thermal conduction component, and the three partial cross-sectional views of the first embodiment of this disclosure respectively, this disclosure discloses an electromagnetic relay 1 having a base 10, at least one fixed conductive sheet assembly 11, at least one movable conductive sheet assembly 12, at least one arc blow component 13, an electromagnet 14 and an outer cap 15.

The fixed conductive sheet assembly 11 is installed in the base 10 and includes a fixed connecting plate 111 and a fixed contact 112, and the fixed contact 112 is disposed at the fixed connecting plate 111. The movable conductive sheet assembly 12 is configured to be corresponsive to the fixed conductive sheet assembly 11 and disposed in the base 10 and includes a movable plate 121 and at least one movable contact 122, and the movable contact 122 is disposed at the movable plate 121 and configured to be corresponsive to the fixed contact 112. The arc blow component 13 is installed on an outer side of the base 10 and disposed on a side of the fixed contact 112 and the movable contact 122. Preferably, the arc blow component 13 is a magnet or electromagnet structure. In this embodiment, the arc blow component 13 is a magnet, and the electromagnetic relay 1 has two arc blow components 13 configured to be opposite to each other. The electromagnet 14 is installed on a side of the movable conductive sheet assembly 12 for driving the movable plate 121, so that the movable contact 122 and the fixed contact 112 form an electrical connection or disconnection due to the electromagnetic effect. Preferably, the electromagnet 14 has a coil structure, and a linking assembly is connected to the movable plate 121, so that after the electromagnet 14 is electrically conducted, the electromagnetic effect generates a magnetic force, and the linking assembly drives the movable plate 121 to move the fixed connecting plate 111, and the movable contact 122 and the fixed contact 112 form an electrical connection or disconnection. The outer cap 15 is covered onto the base 10 and the electromagnet 14 is disposed in the outer cap 15, wherein the outer cap 15 may be in a status of not covering the base 10 or partially covering the base 10 and assembled with the base 10. If the outer cap 15 is in a status of partially covering the base 10, the outer cap 15 can be selectively made of a material with better thermal conductivity.

The electromagnetic relay 1 is characterized in that the whole base 10 is made of a polymer thermal conductive material, and the fixed connecting plate 111 has a first heat conduction part 1111 and a second heat conduction part 1112 for dissipating the heat generated during the electrical connection or disconnection of the movable contact 122 and the fixed contact 112, wherein the first heat conduction part 1111 is disposed in the base 10, and the second heat conduction part 1112 is connected to an end of the first heat conduction part 1111 and extended to the outside of the base 10. The electromagnetic relay 1 further includes at least two thermal conduction components 16 installed in the base 10 and symmetrically configured and respectively disposed on two opposite sides of the fixed contact 112 and the movable contact 122 for dissipating the heat. Preferably, the arc blow components 13 and the thermal conduction components 16 are configured to be perpendicular to each other to facilitate an electric arc to be guided to the thermal conduction components 16 by a magnetic blowing effect. With the structure of the base 10, the fixed connecting plate 111 and the thermal conduction components 16, the heat generated during the operation of the electromagnetic relay 1 can be effectively dissipated by the base 10 or the thermal conduction components 16 or by the first heat conduction part 1111 and the second heat conduction part 1112 of the fixed connecting plate 111 to effectively extend the service life of the electromagnetic relay 1. In addition, the thermal conduction component 16 not just plays the role of dissipating the heat generated during the operation of the electromagnetic relay 1 only, but also achieves the function of cutting and eliminating the electric arc generated during the operation of the electromagnetic relay 1 under the effect of the arc blow component 13, and further effectively eliminates the adverse factors that affect the electromagnetic relay 1.

Further, in this embodiment, each of the thermal conduction components 16 has a total height L of 13.5~20 mm to provide sufficient heat conduction volume. Preferably, the base 10 has at least two receiving slots 101, and the thermal conduction components 16 are disposed in the receiving slots 101 to form an arc-cutting chamber for guiding and cutting an electric arc generated during the operation of opening and closing the fixed contact 112 and the movable contact 122. More specifically, when the thermal conduction components 16 are disposed in the base 10, three sides of the thermal conduction components 16 can be abutted against or disposed adjacent to the sidewall and bottom of the receiving slots 101, so that a chamber-like structure is formed at such position to facilitate the cutting of the electric arc. Therefore, the thermal conduction component 16 has the effect of dissipating the heat generated during the operation of the electromagnetic relay 1 to the outside, as well as assisting the formation of an arc-cutting chamber to improve the arc-cutting effect provided that the base 10 has the receiving slots 101.

Preferably, the first heat conduction part 1111 is disposed at a middle section position of the fixed connecting plate 11 to serve as a middle-section thermal conduction part, and the first heat conduction part 1111 is embedded into the base, so that the heat can be transmitted from the first heat conduction part 1111 to the base 10 for dissipation. The second heat conduction part 1112 is disposed at a rear-section position of the fixed connecting plate 111 to serve as a rear-section radiation part, and the second heat conduction part 1112 and the first heat conduction part 1111 are formed into an integral structure, so that the heat can be radiated and dissipated from the second heat conduction part 1112 to the air. In a preferred embodiment, each of the thermal conduction components 16 includes a plurality of thermally conductive fins 161, a first insulating side plate 162 and a second insulating side plate 163, and the thermally conductive fins 161 are arranged from top to bottom and parallelly spaced from one another, and each of the thermally conductive fins 161 is made of metal, and the first insulating side plate 162 is connected to a first side 1611 of each of the thermally conductive fins 161, and the second insulating side plate 163 is connected to a second side 1612 of each of the thermally conductive fins 161, wherein the first side 1611 and the second side 1612 are configured to be parallel and opposite to each other. When the thermal conduction component 16 includes the thermally conductive fins 161, the configuration can be further limited. For example, the spacing D between two adjacent thermally conductive fins 161 is 0.5~2.5 mm, or the quantity of thermally conductive fins 161 is 5~15, so that each of the thermal conduction components 16 has better thermal conduction and arc-cutting performance. In addition, each of the thermal conduction components 16 has a total height L of 13.85 mm, and the spacing D between two adjacent thermally conductive fins 161 is 1 mm, and the quantity of thermally conductive fins 161 is 8 in this embodiment.

The first heat conduction part 1111 transmits the heat to the base 10 by the thermal conduction characteristics and then eliminates the heat. Part of the heat can continue to be conducted along the fixed connecting plate 111 to the position of the second heat conduction part 1112 outside the base 10, and then heat transmitted to such position can be radiated to the air by the second heat conduction part 1112 for dissipation to achieve an excellent heat dissipation effect. The thermal conduction components 16 with the aforementioned structure can effectively transmit part of the heat generated during the operation of the electromagnetic relay 1 to the base 10 by the thermally conductive fins 161, and then dissipate the heat to the outside by the thermal conduction characteristic of the base 10. Of course, when the first insulating side plate 162 and the second insulating side plate 163 are provided, the heat can also be transmitted to the first insulating side plate 162 and the second insulating side plate 163 for dissipation, so as to improve the overall thermal conduction effect. In addition, the thermal conduction components 16 based on the aforementioned structural design allow each of the thermal conduction components 16 to form a multi-layered sheet structure in the base 10. Since the thermally conductive fins 161 are spaced from each other to include a plurality of airflow spaces, therefore after the electric arc is formed during the arc-cutting operation of the thermal conduction components 16 and the heat of the electric arc is transmitted to the thermally conductive fins 161, the airflow spaces between each of the thermally conductive fins 161 drives part of the heat to be dissipated in a direction towards the fixed connecting plate 111 or the base 10 by convection, and the other part of the heat can be conducted by the thermally conductive fins 161, the first insulating side plate 162, the second insulating side plate 163 and the base 10 for dissipation, which also assists improving the service life of the electromagnetic relay 1. In addition to the aforementioned heat dissipation method, the heat generated by the electric arc can also be transmitted from the thermally conductive fins 161 through the base 10 to the first heat conduction part 1111 of the middle-section thermal conduction part and then transmitted to the second heat conduction part 1112 of the rear-section radiation part for dissipation. The heat generated during the connection and disconnection of the fixed contact 112 and the movable contact 122 can also be radiated to the thermally conductive fins 161, and then dissipated from the base 10 to the outside directly, or the heat is dissipated through the aforementioned conduction path. Therefore, the thermally conductive fins 161 have the effect of dissipating the heat bidirectionally. Regardless of the heat generated by the electric arc or the heat generated by the contacts, they can be dissipated by the thermally conductive fins 161.

As to the cutting of the electric arc, when the electric arc is moved towards the thermal conduction components 16 due to the effect of the arc blow component 13, the electric arc will be divided into a plurality of short electric arcs, under the effect of the thermally conductive fins 161, and the mutually insulated thermally conductive fins 161 are equivalent to the electrodes of the short electric arc, and the externally applied voltage for forming the electric arc cannot be maintained due to the insulation between the thermally conductive fins 161, so that the electric arc can be cut and extinguished.

In this embodiment, the first side 1611 has a length greater than the length of the second side 1612, so that the whole thermally conductive fin 161 is of a tapered form. Preferably, the second insulating side plate 163 has a length smaller than the length of the first insulating side plate 162. A third side 1613 each of the thermally conductive fins is perpendicularly connected to the first side 1611 and the second side 1612 and configured to be corresponsive to an inner side of the base 10, so that the first side 1611 of each of the thermally conductive fins 161 is configured to be corresponsive to the main arc blow direction. In this structure, the first sides 1611 of the thermally conductive fins 161 have a length greater than the length of the second sides 1612, so that the electric arc also the arc ignition effect. After the thermal conduction components 16 are installed to the base 10, the first sides 1611 of the thermally conductive fins 161 will be farther from the movable contact 122 and the fixed contact 112 than the second sides 1612, so that when the electric arc is generated, the electric arc will be attracted to be away from the contacts to reduce the affection to the contacts by the electric arc. More specifically, the thermally conductive fins 161 of this disclosure are tapered structure with unequal width at both ends and capable of cutting and extinguishing the electric arc more accurately according to the direction of the electric arc and providing further characteristics of the thermal conduction component which are conducive to heat conduction and arc extinguishing while protecting the relay. At the same time, more consideration should be given to the design of a structure with excellent arc-cutting and thermal conduction that can be implemented in the limited space of the electromagnetic relay to avoid increasing the volume of the relay. Most of the conventional relays or their arc-extinguishing designs only focus on the arc extinguishing effect. As to the guidance of heat or the way of being implemented in the limited space of the relay, there is still no proposed solution on how to minimize the volume while maintain the arc cutting effect and make the finished goods have excellent arc cutting effect and minimized volume. Besides, the modular design of the thermal conduction components 16 also has convenience in manufacturing and assembling operations and the advantage of being replaced easily.

Figure 4A:
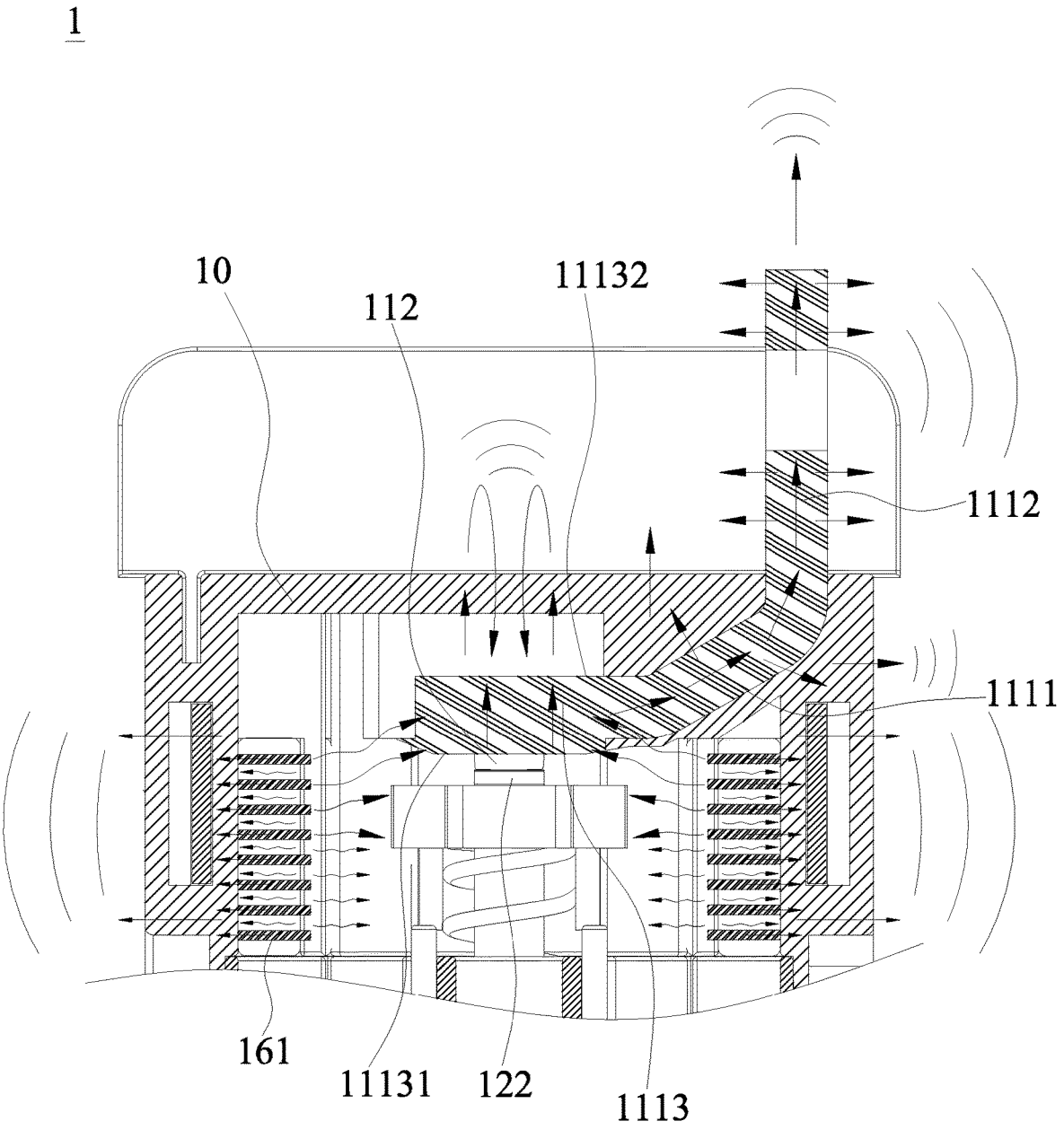
FIG. 4A is a first partial cross-sectional view of an electromagnetic relay in accordance with the first embodiment of this disclosure.

In addition, a third heat conduction part 1113 is extended from an end of the first heat conduction part 1111 of the fixed connecting plate 111 which is opposite to the end connected to the second heat conduction part 1112, and the third heat conduction part 1113 is disposed at a front-section position of the fixed connecting plate 111 to serve as a front-section thermal convection part, and the third heat conduction part 1113 is configured to be opposite to the movable conductive sheet assembly 12 to form a high temperature formation zone 11131 and a convection zone 11132, and the high temperature formation zone 11131 and the convection zone 11132 are configured to be up and down relative to each other, and the convection zone 11132 is exposed from the base 10 and clamped with an outer surface of the base 10 to form a thermal convection space, and the high temperature formation zone 11131 is provided for receiving the heat generated during the operation of the fixed contact 112 and the movable contact 122, and dissipated through the convection zone 11132 and the thermal convection space. Specifically, the base 10 has a through hole configured to be corresponsive to the third heat conduction part 1113 and provided for exposing the convection zone 11132 to form the thermal convection space. In this embodiment, the high temperature formation zone 11131 is an area for installing the fixed contact 112, so that after the movable contact 122 and the fixed contact 112 are contacted and conducted, a part of the generated heat is transmitted from the high temperature formation zone 11131 to the convection zone 11132, and a heat convection loop is formed in the thermal convection space defined by the convection zone 11132 and the through hole for the heat dissipation. The other part of the heat is transmitted to the first heat conduction part 1111 and dissipated quickly in response to the base 10 made of the polymer thermal conductive material, and part of the heat can continue to be transmitted to the second heat conduction part 1112 by radiation for dissipation, so as to achieve an excellent thermal conduction effect, and the heat dissipation path is shown in FIG. 4A. Further, the fixed connecting plate 111 of this embodiment is an L-shaped bent sheet which is partially embedded into the base 10, and the second heat conduction part 1112 of the fixed connecting plate 111 is the part exposed form the base 10, and the third heat conduction part 1113 is the part disposed in the base 10 for installing the fixed contact 112, and finally the first heat conduction part 1111 is the part disposed between the second heat conduction part 1112 and the third heat conduction part 1113 and buried in the base 10. For simplicity, the structure of the outer cap 15 is omitted in FIGS. 4A and 4C to facilitate the illustration of this embodiment. In addition, the heat caused by cutting the electric arc can be dissipated directly to the outside through the base 10, and can also be transmitted by radiation to the high temperature formation zone 11131, wherein the heat is transmitted from the third heat conduction part 1113 of the front-section convection to the first heat conduction part 1111 which is the middle-section thermal conduction part and the second heat conduction part 1112 which is the rear-section radiation part, and then dissipated to the outside. As to the way of dissipating the heat in the transmission path, it has already described above, and thus will be repeated.

In the thermal conduction components 16, if the thermally conductive fins 161 are of the aforementioned structure, the thermally conductive fins 161 of a preferred embodiment is a right-angle trapezoidal sheet, and a fourth side 1614 of the thermally conductive fins 161 is a slope or a side as shown in this embodiment, and the fourth side 1614 of the thermally conductive fins 161 has a first section 16141, a second section 16142 and a third section 16143, wherein an end of the first section 16141 is perpendicularly connected to the first side 1611, and an end of the third section 16143 is perpendicularly connected to the second side 1612, and the second section 16142 is disposed between the first section 16141 and the third section 16143 and obliquely connected to the first section 16141 and the third section 16143. Therefore, when the thermally conductive fins 161, the first insulating side plate 162 and the second insulating side plate 163 are assembled and combined with one another, the right-angled structure formed by the perpendicularly connected first section 16141 and third section 16143 and the perpendicularly connected first side 1611 and second side 1612 is provided for making the assembly of the thermally conductive fins 161 with the first insulating side plate 162 and the second insulating side plate 163 more stable. In other words, the thermally conductive fins 161, the first insulating side plate 162 and the second insulating side plate 163 have more connecting areas.

Further, the base 10 of this embodiment has a partition 102 disposed therein to divide the interior of the base 10 into two accommodation areas 103, and each of the accommodation areas 103 has the fixed conductive sheet assembly 11, and the movable plate 121 has two of the movable contacts 122 formed thereon, wherein there are four thermal conduction components 16, and each of the accommodation areas 103 has two of the thermal conduction components 16, and the second insulating side plate 163 of each of the thermal conduction components 16 is adjacent to the partition 102. In this embodiment, the electromagnetic relay 1 has two electrically conductive structures, and the partition 102 is a convex sheet structure or a concave groove structure, or any structure capable of separating the base 10 into two accommodation areas 103. Each of the accommodation areas 103 has one fixed contact 112 and one movable contact 122 which form two contact groups for an electrical contact during the operation of the electromagnetic relay 1. In this embodiment, the electromagnetic relay 1 has two fixed conductive sheet assemblies 11 (wherein each of the accommodation areas 103 has one fixed conductive sheet assembly 11) and one movable conductive sheet assembly 12 with two movable contacts 122, wherein the single movable plate 121 synchronously drives the two movable contacts 122 to ensure that the movable contacts 122 can be moved synchronously and simplify the design of the linking assembly for connecting the electromagnet 14 and the movable plate 121, so as to reduce the complexity of the structure. It is noteworthy that the second side 1612 has a length smaller than the length of the first side 1611, and the second insulating side plate 163 has a length smaller than the length of the first insulating side plate 162. If the electromagnetic relay 1 has two electric contact groups, such design will be able to better prevent the electric arc from moving to a position between the two electric contact groups to enhance the insulation.

During the operation of the electromagnetic relay 1, the electromagnet 14 drives the movable plate 121 to shift due to the electromagnetic effect, so that the movable contact 122 on the movable plate 121 can be contacted or detached relative to the fixed contact 112. At this time, the electric arc generated at the moment of the operation is moved towards the thermal conduction components 16 due to the effect of the arc blow components 13 and divided into a plurality of short electric arcs by the thermally conductive fins 161, wherein this disclosure is based on the overall design of the electromagnetic relay 1 and the effect of the electric field, so that the electric arc is not moved in a direction uniformly touching the whole area of the fourth side 1614 of the thermally conductive fins 161, but slightly tilting towards the positions on the first side 1611 of the thermally conductive fins 161. At this time, the structural characteristic of the first sides 1611 with a length greater than the length of the second sides 1612 can effectively cut and blow the electric act at such positions to reduce its energy until its elimination. Meanwhile, the high-temperature heat generated by the electric arc can be dissipated to the outside by the thermal conduction components 16, and part of the heat can also be transmitted from the first heat conduction part 1111 to the base 10 for dissipation, and part of the heat can be dissipated by the second heat conduction part 1112 and the third heat conduction part 1113, and the heat generated after the electric arc is guided to the thermally conductive fins 161 is mainly dissipated by the thermally conductive fins 161.

Figure 4B:
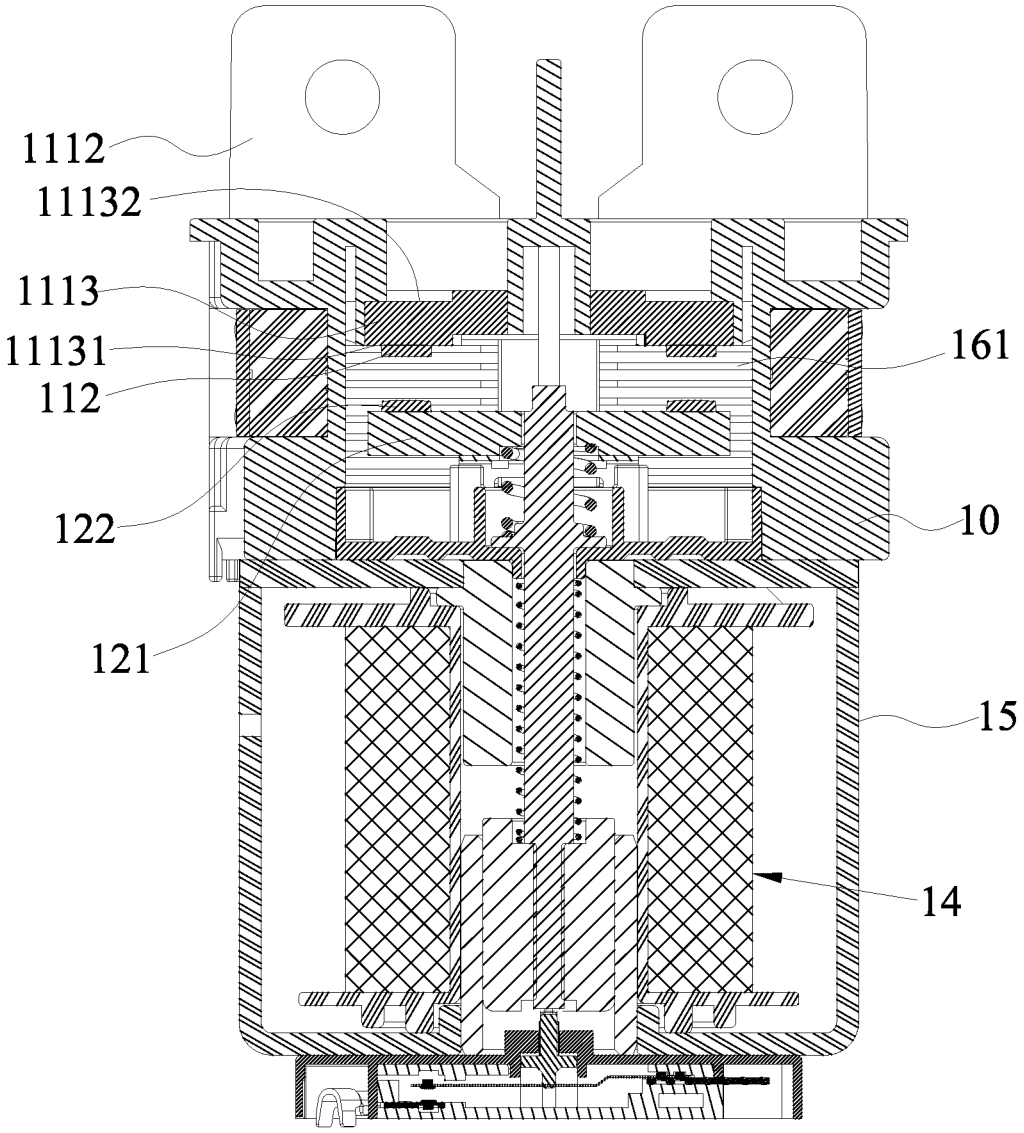
FIG. 4B is a second partial cross-sectional view of an electromagnetic relay in accordance with the first embodiment of this disclosure.
Figure 4C:
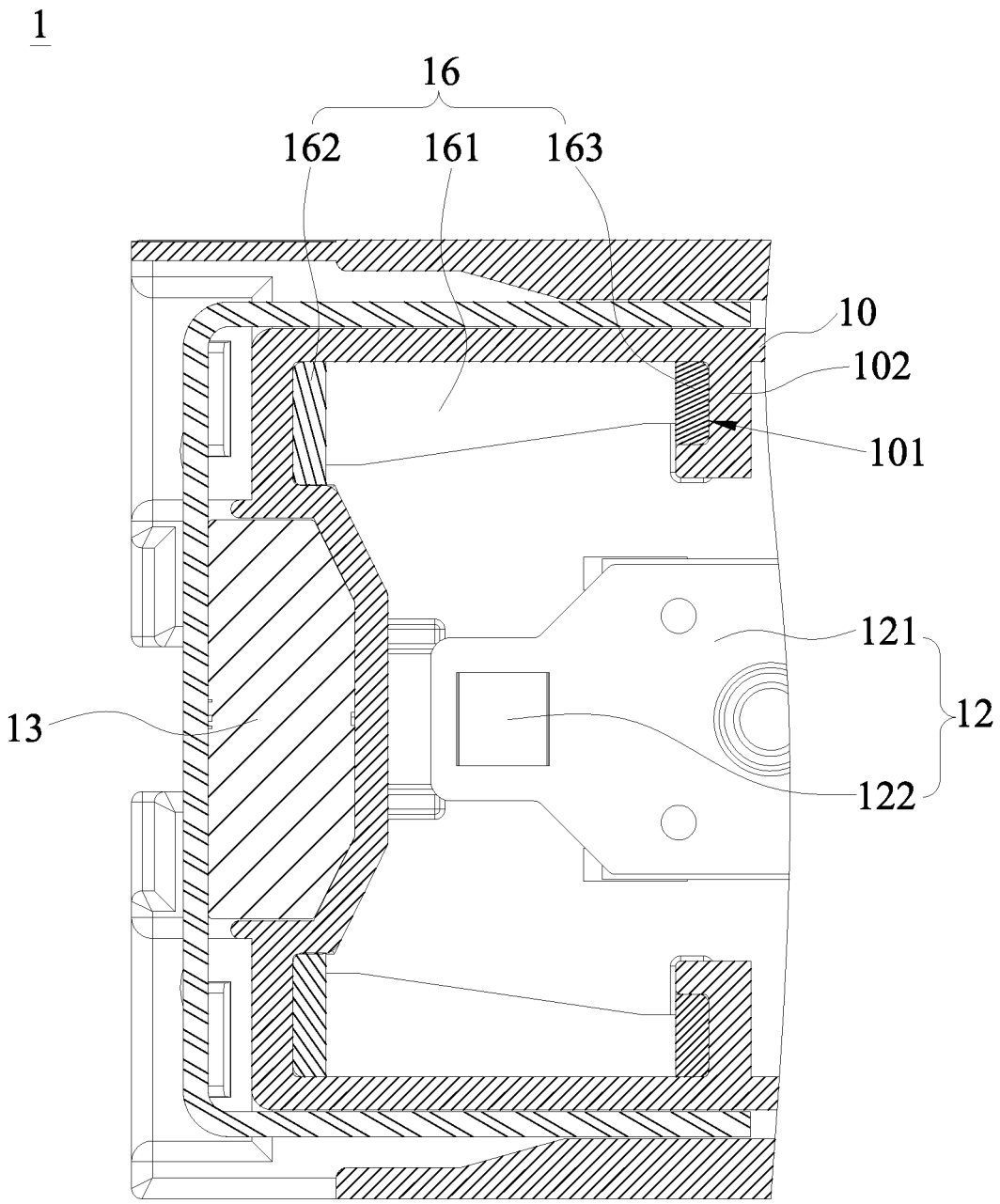
FIG. 4C is a third partial cross-sectional view of an electromagnetic relay in accordance with the first embodiment of this disclosure.
Figure 5:
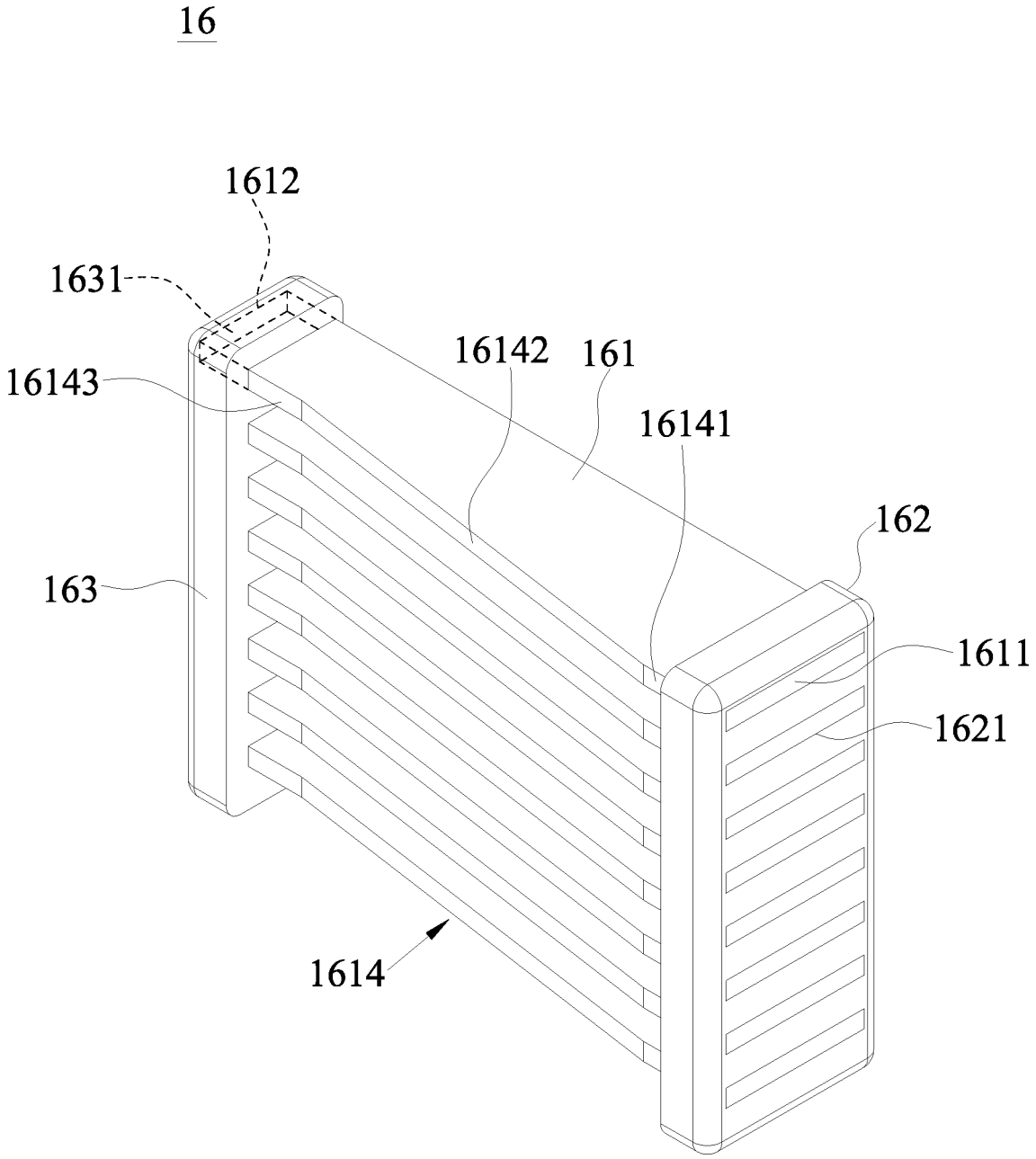
FIG. 5 is a perspective view of a thermal conduction component in accordance with a second embodiment of this disclosure.

With reference to FIG. 5 for the perspective view of a thermal conduction component in accordance with the second embodiment of this disclosure, an end of the thermally conductive fins 161 (which is the first side 1611 or the second side 1612) is embedded into the first insulating side plate 162 and the second insulating side plate 163. The arrangement of the first embodiment can also be one as disclosed in this embodiment, wherein the first insulating side plate 162 and the second insulating side plate 163 has a plurality of openings 1621, 1631 respectively for fixing the ends of the thermally conductive fins 161 to make the assembly and manufacture simpler and more convenient. The openings 1621, 1631 of the first insulating side plate 162 and the second insulating side plate 163 are formed in advance according to the spacing and position of the thermally conductive fins 161 before the manufacture, and then the ends of the thermally conductive fins 161 are fixed into the openings 1621, 1631 one by one. After the thermally conductive fins 161 are installed to the openings 1621, 1631, the first side 1611 and the second side 1612 of each of the thermally conductive fins 161 are cut evenly with outer surfaces of the first insulating side plate 162 and the second insulating side plate 163 or slightly recessed into the outer surfaces of the first insulating side plate 162 and the second insulating side plate 163 respectively. The thermal conduction component 16 installed in the base 10 is shown in FIG. 4C.

Figure 6:
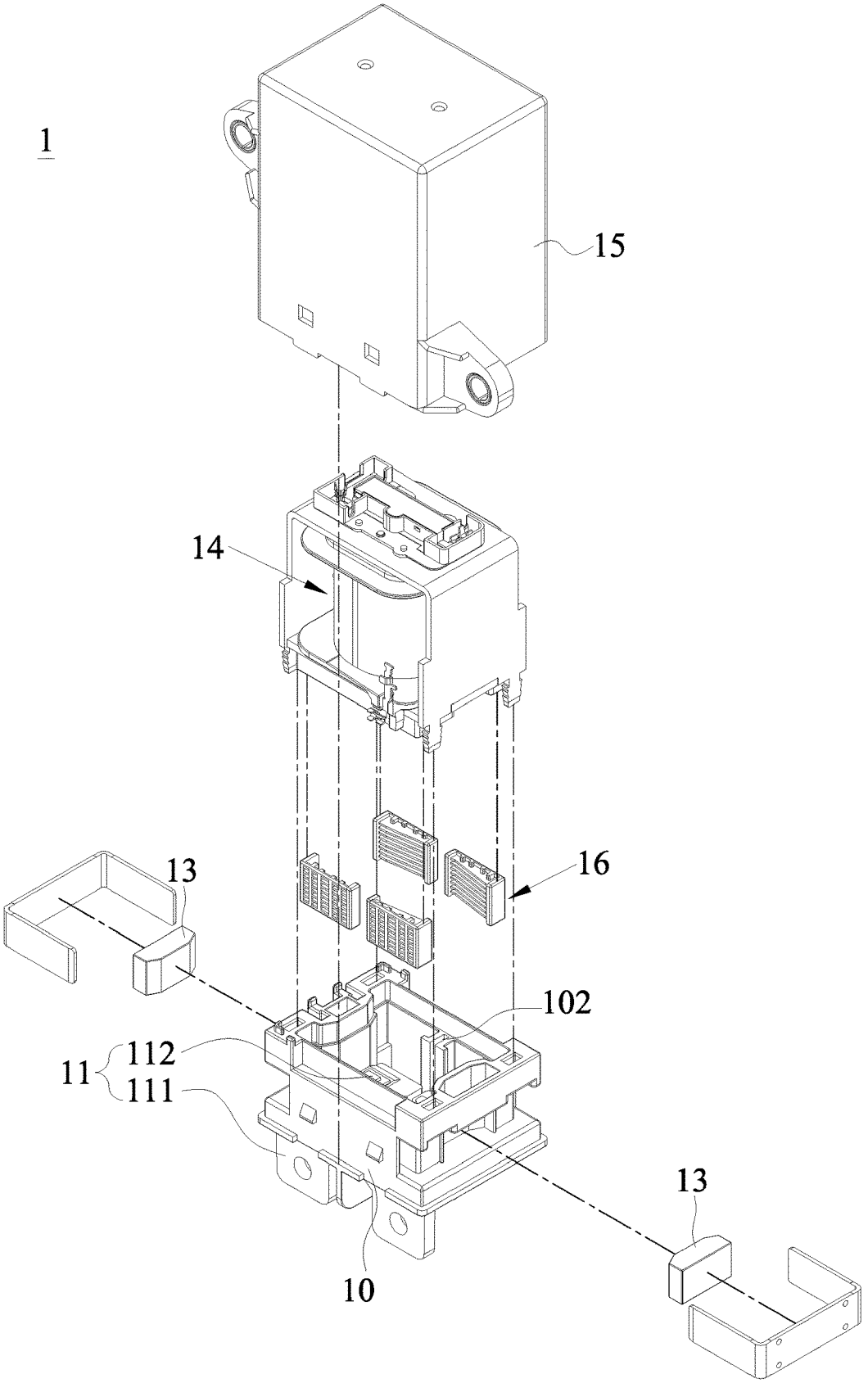
FIG. 6 is an exploded view of an electromagnetic relay in accordance with a third embodiment of this disclosure.
Figure 7A:
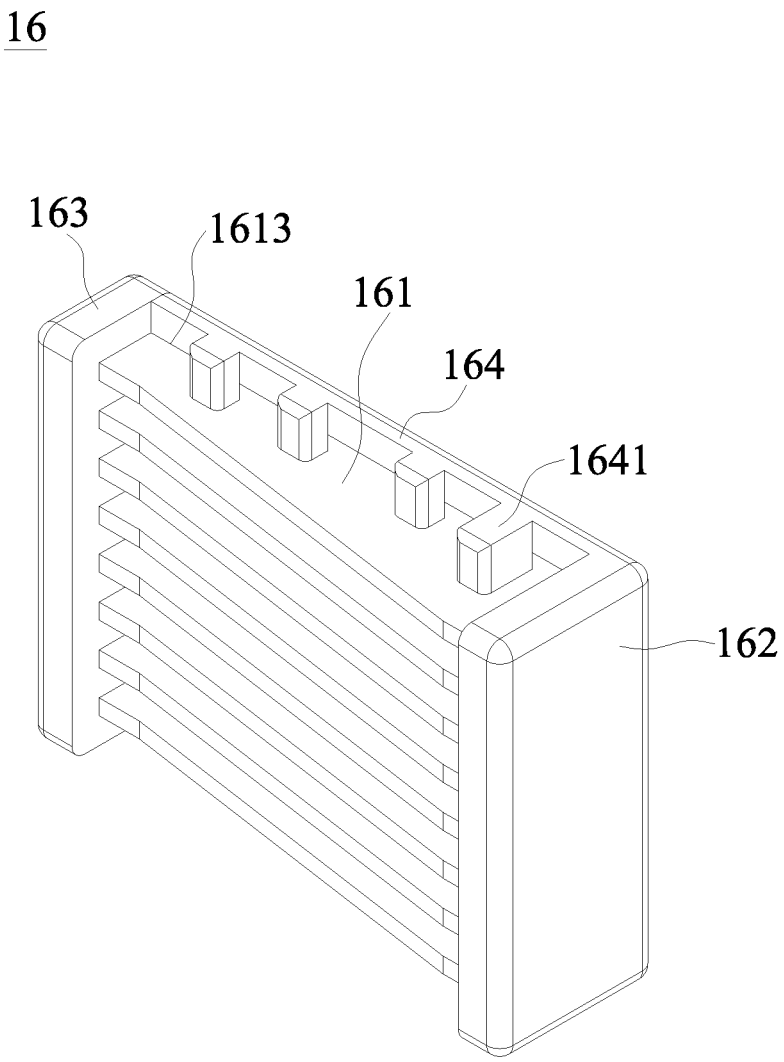
FIG. 7A is a perspective view of a thermal conduction component in accordance with the third embodiment of this disclosure.
Figure 7B:
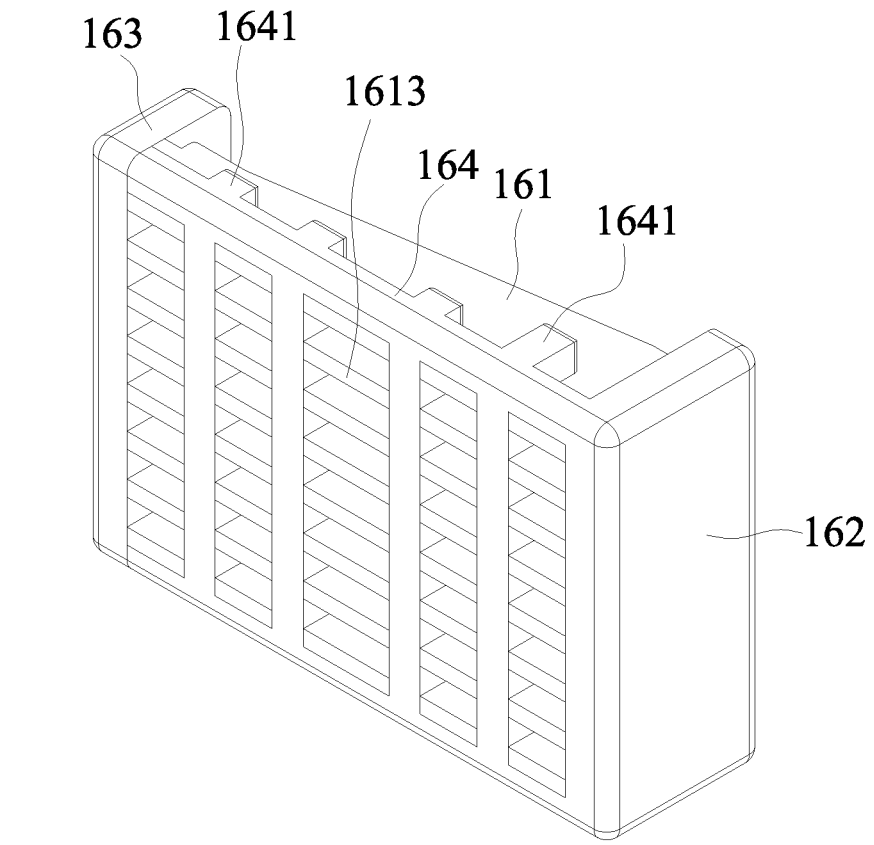
FIG. 7B is another perspective view of a thermal conduction component in accordance with the third embodiment of this disclosure.
Figure 8:
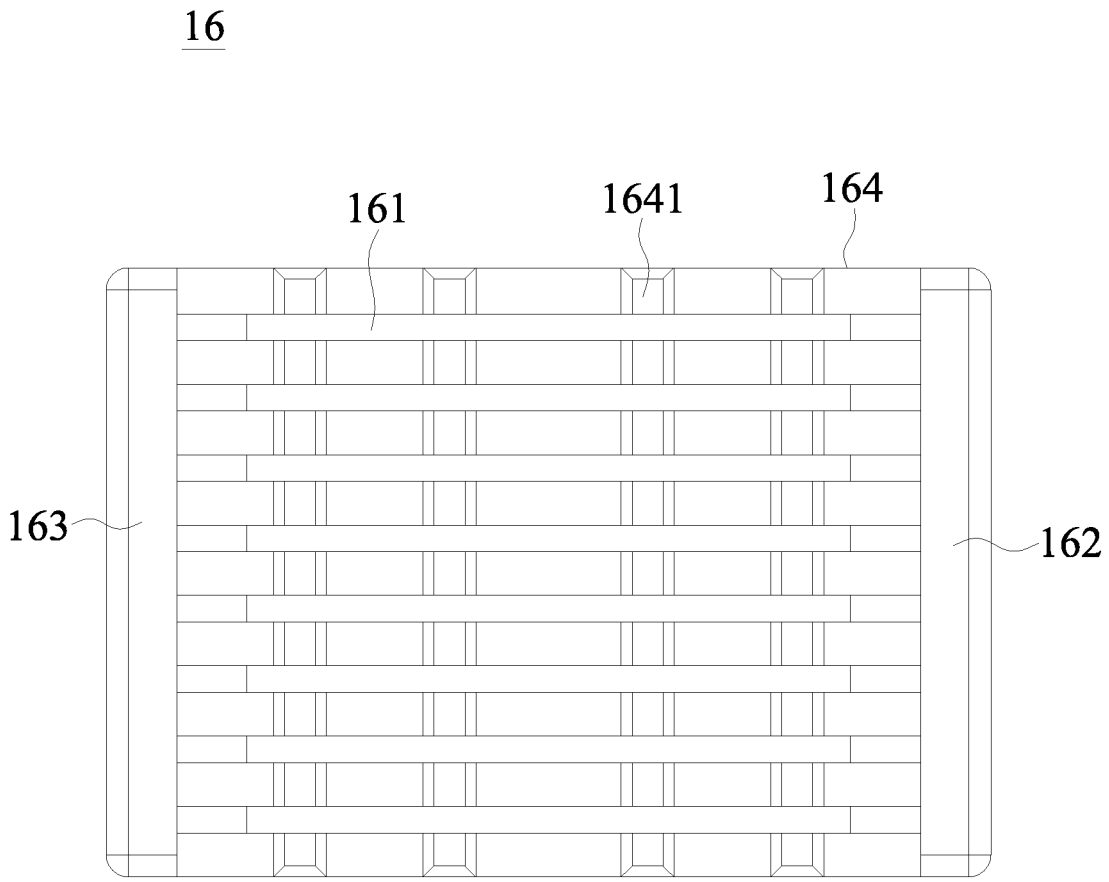
FIG. 8 a planar view of a thermal conduction component in accordance with the third embodiment of this disclosure.

With reference to FIGS. 6 to 8 for the exploded view of an electromagnetic relay, the two perspective views and the planar view of a thermal conduction component in accordance with the third embodiment of this disclosure respectively, the components of the electromagnetic relay 1 of this embodiment are substantially the same as those of the first embodiment, so that the same numeral in the figures is used to represent the same respective component. The thermal conduction component 16 further includes an insulator 164, and both ends of the insulator 164 are connected to the first insulating side plate 162 and the second insulating side plate 163 respectively and disposed on the third side 1613 of the thermally conductive fins 161. By the structure of the insulator 164, the insulator 164 is an object that provides further protection and guides the heat. Preferably, the insulator 164 is a sheet structure, a frame structure, etc. and the insulator 164 is connectable to each of the thermally conductive fins 161 or partially connected to the thermally conductive fins 161.

In order to improve the overall structural rigidity of the thermal conduction component 16 and the insulation and thermal conduction, the insulator 164 further has a plurality of reinforcing ribs 1641 configured to be perpendicular to the thermally conductive fins 161 and staggered with the thermally conductive fins 161, wherein the reinforcing rib 1641 closest to the first side 1611 of each of the thermally conductive fins 161 has a length greater than the length of the remaining reinforcing ribs 1641. The reinforcing ribs 1641 are arranged from top to bottom and configured to be perpendicularly penetrating the thermally conductive fins 161 and staggered with the thermally conductive fins 161 respectively, so that the thermal conduction component 16 can have sufficient rigidity to achieve the effects of eliminating the heat, improving the insulation between the thermally conductive fins 161, and increasing the distance along the surface to cut the arc more effectively. Preferably, the insulator 164 and the reinforcing ribs 1641 are made of the same material of the first insulating side plate 162 and the second insulating side plate 163. As described above, the first side 1611 of the thermally conductive fins 161 is configured to be corresponsive to the main arc blow direction of the electric arc, so that theoretically it will withstand more electric arc energy, and the reinforcing rib 1641 at such position is designed with a length greater than that of the reinforcing ribs 1641 to maximize the effectiveness.

The operation, arc blowing, arc cutting, and thermal conduction of the electromagnetic relay 1 of this embodiment are the same as those of the first embodiment and thus will not be repeated, and the electric arc is affected by the arc blow components 13 to pass through the thermal conduction components 16, and when the electric arc is under the effect of the thermal conduction components 16, the energy is reduced gradually, the insulator 164 and the reinforcing ribs 1641 can improve the rigidity of the thermal conduction components 16 to effectively execute the arc cutting and thermal conduction and extend the service life of the electromagnetic relay 1. For the rest of the detailed characteristics and effects, please refer to the content described in the above relevant paragraph. With reference to FIG. 4C for the schematic view of the thermal conduction component 16 installed in the base 10, the difference between this embodiment and the previous embodiment resides on that each of the thermal conduction components 16 of this embodiment has the insulator 164 and the reinforcing ribs 1641, and the insulator 164 and the reinforcing ribs 1641 are configured as described in the above content and illustrated by the relevant figures.

Figure 9:
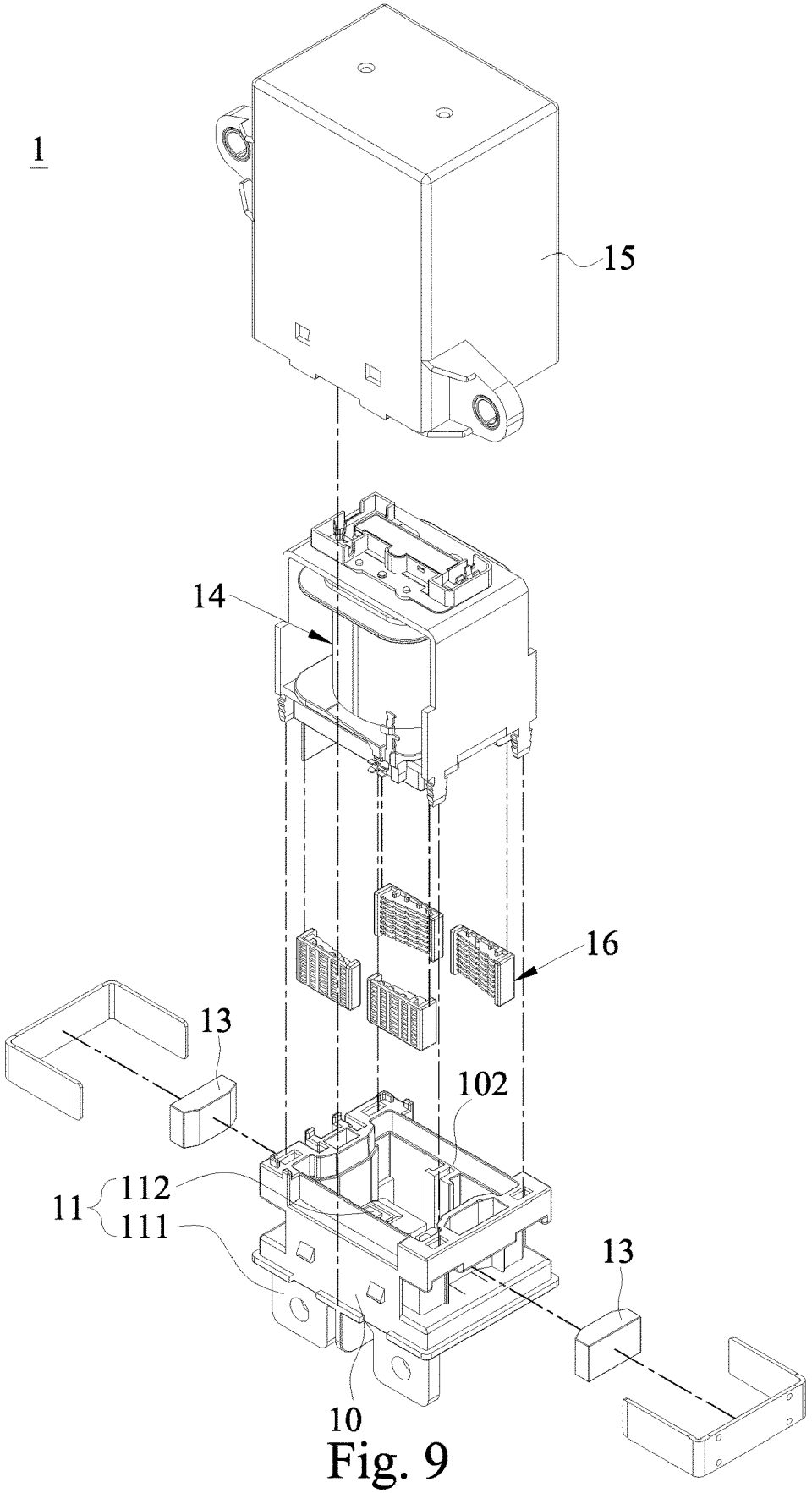
FIG. 9 is an exploded view of an electromagnetic relay in accordance with a fourth embodiment of this disclosure.
Figure 10:
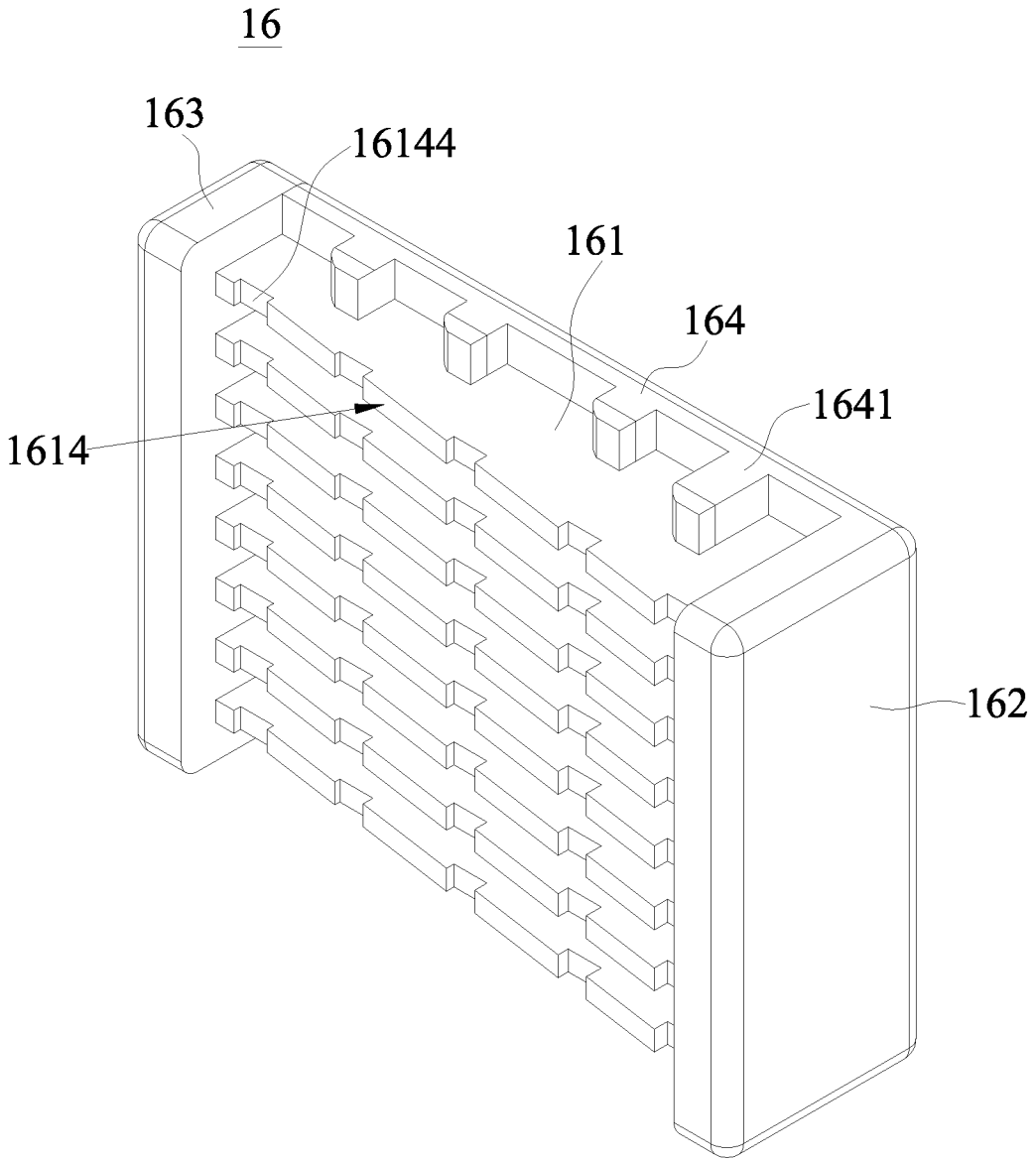
FIG. 10 is a perspective view of a thermal conduction component in accordance with the fourth embodiment of this disclosure.

With reference to FIGS. 9 and 10 for the exploded view of an electromagnetic relay and the perspective view of a thermal conduction component in accordance with the fourth embodiment of this disclosure respectively, the same numeral is used to represent the same respective components in the figures, and the electromagnetic relay 1 of this embodiment is substantially the same as those of the first to third embodiments except that a fourth side 1614 of each of the thermally conductive fins 161 of this embodiment has a plurality of notches 16144, wherein the fourth side 1614 has an end connected to the first side 1611 and the other end connected to the second side 1612. The notches 16144 can be in an arc, rectangular or triangular shape, etc., and when the fourth side 1614 of each of the thermally conductive fins 161 has the notches 16144, a corresponding protrusion is formed on the fourth side 1614, so that when the electric arc is generated, the corresponding protrusion on the fourth side 1614 will have a guiding effect to the electric arc, so that the electric arc will act according to the effect of the arc blow components 13 and will be attracted by the protrusion, and the thermal conduction component 16 has a secondary arc ignition effect on the electric arc to improve the reliability of guiding the electric arc by the thermal conduction component 16. In other words, the arc cutting effect can be improved to cut the electric arc finer. In a preferred embodiment, more notches 16144 are formed in an area near the fourth side 1614 in order to gather more energy of the electric arc on the first side 1611 of the thermally conductive fins 161 and more corresponding protrusions are formed to achieve a better effect of attracting the electric arc.

Similarly, if the thermally conductive fins 161 have the notches 16144, the thermal conduction components 16 further have the insulator 164 and the reinforcing ribs 1641 to reduce the affection caused by the direct contact of the energy of the electric arc with the base. The insulator 164 is also installed at a position of the third side 1613 of the thermally conductive fin 161 and connected to each of the third sides 1613 or connected to a part of the third side 1613. The reinforcing ribs 1641 is also perpendicular to the thermally conductive fins 161 to form a staggered configuration, but if each fourth side 1614 has the notches 16144, the reinforcing ribs 1641 will be disposed between any two adjacent notches 16144, and the length of the reinforcing rib 1641 closest to the first side 1611 of each of the thermally conductive fins 161 is greater than the length of the remaining reinforcing ribs 16411. Since the electric arc has the effect of being attracted by sharp points, therefore when the thermally conductive fins 161 have the notches 16144, the electric arc will be attracted by the protruding part from each fourth side 1614 and gathered. To prevent too much energy of the electric arc from being gathered in some areas such that some areas of the base 10 need to receive a large amount of heat, the reinforcing ribs 1641 are installed at the positions between any two adjacent notches 16144, and such positions are the parts protruding from each of the fourth sides 1614. The thermal conduction component 16 of this embodiment is installed in the base 10 as shown in FIG. 4B, and its difference from the previous embodiments resides on that each of the thermal conduction components 16 of this embodiment has the notches 16144, the insulator 164 and the reinforcing ribs 1641, and the configuration of the notches 16144, the insulator 164 and the reinforcing ribs 1641 has been described above and illustrated in the related figures.

As to the application of the electromagnetic relay 1, it is the same as that of the first embodiment, wherein the electric arc generated after the operation of the electromagnetic relay 1 is affected by the arc blow components 13 to shift towards the thermal conduction components 16 and the electric arc is cut by the thermal conduction components 16. At this time, the notches 16144 make each of the fourth sides 1614 to produce the protruding areas capable of igniting the electric arc, so that the electric arc can be further guided to the thermally conductive fins 161, and the insulator 164 and the reinforcing ribs 1641 can achieve the further heat conduction effect. The dissipation path of the heat is also the same as that of the first embodiment. Please refer to the related content described above for the detailed characteristics and effects.

In summation of the description above, the electromagnetic relay of this disclosure is designed for dissipating the high-temperature heat generated during the operation of the electromagnetic relay, and the special structural design of the thermal conduction component and fixed connecting plate can effectively dissipate the heat generated during the operation of the electromagnetic relay. Further, the thermally conductive fins of the thermal conduction component are capable of extinguishing the electric arc generated during the operation of the relay, eliminating the adverse effects caused by the electric arc on the relay, and combining the receiving slots to form the arc-cutting chamber. In order to improve the application performance of the electromagnetic relay, this disclosure also discloses the modular concept of thermal conduction component to assemble or replace the thermal conduction component easily. With the modular design, the structures including the insulator, the reinforcing rib, etc. and the thermal conduction components with better implementation and specification can be added to the thermal conduction component. In this disclosure, the overall design can effectively overcome the problem of the conventional relay that cannot dissipate the generated heat to the outside smoothly. At the same time, the design of this disclosure with excellent thermal conduction performance provides the function of cutting and extinguishing the electric arc of the relay. Further, both ends of the thermal conduction components are of unequal widths can cut and extinguish the electric arc according to the direction of the electric arc. Many characteristics of the thermal conduction components are further taken into consideration to implement the thermal conduction components into the limited space of the electromagnetic relay, so that the thermal conduction components concurrently has the excellent heat conduction, arc cutting and protection functions to avoid the design that will increase the volume of the relay. In view of the facts that the conventional relays still have not yet provided the design of minimizing the volume and maintaining certain heat conduction and arc-cutting effect within the limited space of the relay for the finished goods having the advantages of good heat conduction, arc cutting, and protection and small volume, the discloser of this disclosure based on years of experience in the related industry to conduct extensive research, experiment and test and finally provided the electromagnetic relay in accordance with this disclosure, in hope of providing a better related product to the market.

What is claimed is:

1. An electromagnetic relay, comprising: a base, at least one fixed conductive sheet assembly, at least one movable conductive sheet assembly, at least one arc blow component, an electromagnet and an outer cap, and the fixed conductive sheet assembly being disposed at the base and comprising a fixed connecting plate and a fixed contact, and the fixed contact being disposed at the fixed connecting plate and in the base; the movable conductive sheet assembly being configured to be corresponsive to the fixed conductive sheet assembly and disposed in the base and comprising a movable plate and at least one movable contact, and the movable contact being disposed at the movable plate and configured to be corresponsive to the fixed contact; the arc blow component being installed on an outer side of the base and disposed on a side of the fixed contact and the movable contact; the electromagnet being installed on a side of the movable conductive sheet assembly for driving the movable plate, so that the movable contact and the fixed contact form an electrical connection or disconnection by an electromagnetic effect; the outer cap being covered on the base, and the electromagnet being disposed in the outer cap, and the electromagnetic relay is characterized in that:

the base is made of a polymer thermal conductive material, and the fixed connecting plate has a first heat conduction part and a second heat conduction part, which are provided for dissipating the heat generated during the electrical connection or disconnection of the movable contact and the fixed contact, wherein the first heat conduction part is disposed in the base, and the second heat conduction part is coupled to an end of the first heat conduction part and extended to an outer side of the base; and the electromagnetic relay further comprises at least two thermal conduction components, installed in the base and symmetrically configured with each other, and disposed on the two opposite sides of the fixed contact and the movable contact for dissipating heat.

2. The electromagnetic relay according to claim 1, wherein each of the thermal conduction components has a total height of 13.5~20 mm.

3. The electromagnetic relay according to claim 2, wherein the base has at least two receiving slots, and the thermal conduction components are installed in the receiving slots to form an arc-cutting chamber for guiding and cutting an electric arc generated during the operation of opening and closing the fixed contact and the movable contact.

4. The electromagnetic relay according to claim 1, wherein the first heat conduction part is disposed at a middle section position of the fixed connecting plate to serve as a middle-section thermal conduction part, and the first heat conduction part is embedded into the base, so that heat can be transmitted from the first heat conduction part to the base for dissipation; the second heat conduction part is disposed at a rear-section position of the fixed connecting plate to serve as a rear-section radiation part, and the second heat conduction part and the first heat conduction part are formed into an integral structure, so that heat can be radiated from the second heat conduction part to the air for dissipation; and each of the thermal conduction components comprises a plurality of thermally conductive fins, a first insulating side plate and a second insulating side plate, and the thermally conductive fins are arranged from top to bottom and parallelly spaced from one another, and the first insulating side plate is coupled to a first side of each of the thermally conductive fins, and the second insulating side plate is coupled to a second side of each of the thermally conductive fins, and the first side and the second side are configured to be parallel and opposite to each other.

5. The electromagnetic relay according to claim 4, wherein the base has a partition installed therein for dividing interior of the base into two accommodation areas, and each of the accommodation areas has one of the fixed conductive sheet assemblies, and the movable plate has two of the movable contacts disposed thereon; the quantity of thermal conduction components is four, and each of the accommodation areas has two of the thermal conduction components, and the second insulating side plate of each of the thermal conduction components is configured to be adjacent to the partition.

6. The electromagnetic relay according to claim 4, wherein the first side of each of the thermally conductive fins has a length greater than a length of the second side; and each of the thermally conductive fins have a third side perpendicularly coupled to the first side and the second side, and the third side is configured to be corresponsive to an inner side of the base, so that the first side of each of the thermally conductive fins is configured to be corresponsive to a main arc blow direction.

7. The electromagnetic relay according to claim 6, wherein the base has a partition installed therein for dividing interior of the base into two accommodation areas, and each of the accommodation areas has one of the fixed conductive sheet assemblies, and the movable plate has two of the movable contacts disposed thereon; the quantity of thermal conduction components is four, and each of the accommodation areas has two of the thermal conduction components, and the second insulating side plate of each of the thermal conduction components is configured to be adjacent to the partition.

8. The electromagnetic relay according to claim 6, wherein an end of the first heat conduction part of the fixed connecting plate, which is opposite to the end that coupled to the second heat conduction part, is extended to form a third heat conduction part, and the third heat conduction part is disposed at a front-section position of the fixed connecting plate to serve as a front-section thermal convection part, and the third heat conduction part is configured to be opposite to the movable conductive sheet assembly to form a high temperature formation zone and a convection zone, and the high temperature formation zone and the convection zone are disposed at up and down positions relative to each other, and the convection zone is exposed from the base and clamped with an outer surface of the base to form a thermal convection space, and the high temperature formation zone is provided for receiving the heat generated during the operation of opening and closing the fixed contact and the movable contact, and dissipated through the convection zone and the thermal convection space.

9. The electromagnetic relay according to claim 8, wherein the base has a partition installed therein for dividing interior of the base into two accommodation areas, and each of the accommodation areas has one of the fixed conductive sheet assemblies, and the movable plate has two of the movable contacts disposed thereon; the quantity of thermal conduction components is four, and each of the accommodation areas has two of the thermal conduction components, and the second insulating side plate of each of the thermal conduction components is configured to be adjacent to the partition.

10. The electromagnetic relay according to claim 8, wherein each of the thermally conductive fins has a fourth side configured to be opposite to the third side and has a first section, a second section and a third section, and an end of the first section is perpendicularly coupled to the first side, and an end of the third section is perpendicularly coupled to the second side, and the second section is disposed between the first section and the third section and obliquely coupled to the first section and the third section.

11. The electromagnetic relay according to claim 6, wherein each of the thermal conduction components further comprises an insulator, and both ends of the insulator are coupled to the first insulating side plate and the second insulating side plate respectively, and disposed on the third side of the thermally conductive fins; and the insulator further comprises a plurality of reinforcing ribs perpendicular to the thermally conductive fins and staggered with the thermally conductive fins respectively, and the reinforcing rib closest to the first side of each of the thermally conductive fins has a length greater than the length of the remaining reinforcing ribs.

12. The electromagnetic relay according to claim 10, wherein the fourth side of each of the thermally conductive fins has a plurality of notches spaced from one another, and each of the thermal conduction components further comprises an insulator, and both ends of the insulator are coupled to the first insulating side plate and the second insulating side plate respectively and disposed on the third side of the thermally conductive fins; and the insulator further has a plurality of reinforcing ribs arranged to be perpendicular to the thermally conductive fins and staggered with the thermally conductive fins respectively, and the reinforcing ribs are disposed between any two adjacent notches, and the reinforcing rib closest to the first side of each of the thermally conductive fins has a length greater than the length of the remaining reinforcing ribs.

* * * * *